US011850844B2

(12) United States Patent
Sahun Peres et al.

(10) Patent No.: US 11,850,844 B2
(45) Date of Patent: Dec. 26, 2023

(54) PRINTING MACHINE FOR PRINTING A LAMINAR WEB

(71) Applicant: COMEXI GROUP INDUSTRIES, SAU, Riudellots de la Selva (ES)

(72) Inventors: Jordi Sahun Peres, Bordils (ES); Bernat Recasens Artigues, Cassà de la Selva (ES); Pol Morral Martí, Sant Mori (ES); Andreu Rosales Perez, Blanes (ES); Lluís Turon Castelló, Sant Gregori (ES); Jordi Edo i Flores, Cànoves i Samalús (ES); Joaquim Quintana Vilà, Vidreres (ES)

(73) Assignee: COMEXI GROUP INDUSTRIES, SAU, Riudellots de la Selva (ES)

( * ) Notice: Subject to any disclaimer, the term of this patent is extended or adjusted under 35 U.S.C. 154(b) by 9 days.

(21) Appl. No.: 17/862,247

(22) Filed: Jul. 11, 2022

(65) Prior Publication Data

US 2023/0116239 A1 Apr. 13, 2023

(30) Foreign Application Priority Data

Oct. 11, 2021 (EP) ..... 21382909

(51) Int. Cl.
*B41J 2/51* (2006.01)
*B41J 25/34* (2006.01)
(Continued)

(52) U.S. Cl.
CPC ..... *B41J 15/16* (2013.01); *B41F 19/007* (2013.01); *B41F 33/0081* (2013.01);
(Continued)

(58) Field of Classification Search
CPC ... B41J 15/16; B41J 2/51; B41J 11/002; B41J 19/202; B41J 25/304; B41J 25/3086;
(Continued)

(56) References Cited

U.S. PATENT DOCUMENTS 3,167,166 A * 1/1965 Schiebeler ..... B41J 19/20 400/82
6,367,910 B1 * 4/2002 Sette ..... B41J 25/001 400/630

(Continued)

*Primary Examiner* — Henok D Legesse
(74) *Attorney, Agent, or Firm* — Robert J. Hess; Hess Patent Law Firm

(57) ABSTRACT

Printing machine, for printing a laminar web, comprising a feeding unit (10) defining a printing area (A); an inkjet printing station (20) comprising a plurality of inkjet printing modules (21) slidably arranged along a transverse guide (22); a positioning device (30) adapted to precisely slide the inkjet printing modules (21) along the transverse guide (22); wherein each inkjet printing module (21) includes a first coupling (31) and is independent from other inkjet printing modules (21) allowing an independent movement of each inkjet printing module (21) along the transverse guide (22); and the positioning device (30) includes a second coupling (32) complementary to each first coupling (31), the second coupling (32) being releasably engageable to each first coupling (31) in an automatic manner, the positioning device (30) being configured to precisely slide each inkjet printing module (21) engaged thereto, along the transverse guide (22).

15 Claims, 4 Drawing Sheets

(51) Int. Cl.

| | |
|---|---|
| ***B41J 15/16*** | (2006.01) |
| ***B41J 25/308*** | (2006.01) |
| ***B41J 19/20*** | (2006.01) |
| ***B41J 25/304*** | (2006.01) |
| ***B41J 11/00*** | (2006.01) |
| ***B41F 33/02*** | (2006.01) |
| ***B41F 33/00*** | (2006.01) |
| ***B41F 19/00*** | (2006.01) |
| *B41J 3/54* | (2006.01) |
| *B41F 13/02* | (2006.01) |

(52) U.S. Cl.
CPC ..... *B41F 33/02* (2013.01); *B41J 2/51* (2013.01); *B41J 11/002* (2013.01); *B41J 19/202* (2013.01); *B41J 25/304* (2013.01); *B41J 25/3086* (2013.01); *B41J 25/34* (2013.01); *B41F 13/025* (2013.01); *B41J 3/543* (2013.01); *B41J 11/0022* (2021.01); *B41J 11/00214* (2021.01); *B41J 11/00216* (2021.01); *B41J 11/00218* (2021.01); *B41J 2203/011* (2020.08)

(58) Field of Classification Search
CPC ..... B41J 25/34; B41J 3/543; B41J 11/00214; B41J 11/00216; B41J 11/00218; B41J 11/0022; B41J 2203/011; B41F 19/007; B41F 33/0081; B41F 33/02; B41F 13/025
See application file for complete search history.

(56) References Cited

U.S. PATENT DOCUMENTS

| | | | | |
|---|---|---|---|---|
| 2009/0101064 | A1* | 4/2009 | Naka | B41J 3/28 118/313 |
| 2016/0257129 | A1 | 9/2016 | Oharo | |
| 2018/0215169 | A1 | 8/2018 | Kojima | |
| 2019/0030918 | A1 | 1/2019 | Matsumoto | |
| 2019/0118467 | A1 | 4/2019 | Nubian | |

* cited by examiner

PRINTING MACHINE FOR PRINTING A LAMINAR WEB

TECHNICAL FIELD

The present invention is directed towards a printing machine for printing a laminar web using a plurality of inkjet printing modules independently movable in a transverse direction regarding the laminar web, each inkjet printing module being individually positioned by a positioning device shared with the rest of the inkjet printing modules, the laminar web being tensioned in front of the inkjet printing modules to obtain a high quality printing.

STATE OF THE ART

Wide format printing machine including inkjet printing modules are already known. In a typical configuration a printing bar includes multiple inkjet printing modules adjacent to each other covering the entire width of the web path, allowing for a printing in any desired location on the web.

But in some cases, not the entire width of the web has to be printed, but only some fringes of said web require printing from the inkjet printing modules, for example when only discrete elements have to be printed such as a bar code, a QR code, a fabrication date, an expiration date, and identification number, a batch number, or similar information. In those cases, most of the inkjet printing modules are not necessary and represent an unnecessary cost. Also, the unused inkjet printing modules tend to get dry and require a carefully and expensive maintenance.

Printing machines including several spaced inkjet printing modules, each independently actuated for moving in the transverse direction are already known, for example through document US2003085977A1. This solution allows for the precise positioning of each individual inkjet printing module in a specific position for printing information on that position, but this solution require the use of several positioning devices, one for each inkjet printing module, increasing the cost and the likelihood of failures, and not permitting the addition or removal of individual inkjet printing modules for adapting the inkjet printing station to specific requirements of a certain customer in an easy and economically manner.

Document U.S. Pat. No. 5,677,719A describes a printing machine including multiple parallel and spaced apart inkjet printing modules facing a printing area of a web path, said multiple inkjet printing modules being slidably attached to a transverse guide and being simultaneously actuated by a single positioning device which moves all the inkjet printing modules simultaneously in the transverse direction. But according to this prior art document, the distance between the different inkjet printing modules cannot be automatically changed, not permitting an easy adaptation of the inkjet printing station to different printing jobs.

Document CN210591003U describes a similar solution, but repeating this arrangement multiple times, providing several positioning devices each moving several inkjet printing modules in the transverse direction. As in the previous case, the distance between the inkjet printing modules actuated by the same positioning device cannot be automatically changed, and it requires the use of several independent positioning devices, which increases the cost and the likelihood of failures.

The present invention provides a printing machine with several independent and spaced apart inkjet printing modules which can be independently positioned in the transverse direction and allowing the easy inclusion or removal of individual inkjet printing modules for adapting the printing machine to different requirements of different customers in an easy and economically manner, providing a solution to the above listed and other problems.

BRIEF DESCRIPTION OF THE INVENTION

The present invention is directed towards a Printing machine for printing a laminar web.

The proposed printing machine comprises, in a manner already known in the state of the art:

- rollers defining a web path for guiding a web, the rollers including first and second supporting rollers defining therebetween a printing area of the web path, the pulling device being adapted to maintain a constant tension in the web guided through the printing area;
- an inkjet printing station comprising a plurality of inkjet printing modules facing the printing area of the web path for printing thereon and slidably arranged along a support transverse to the web path, to print digitally modifiable items at different regions of the printing area;
- a positioning device adapted to precisely slide the inkjet printing modules along the transverse guide in the direction transversal to the web path.

It will be understood that the digitally modifiable items are items stored in a digital file which can be digitally modified by electronic means and printed by a digitally controlled printing device, in this case an inkjet printing module, allowing the modification of the items while printing.

According to that, a continuous web can be unwound from an unwinding reel, driven by a pulling device along the web path in a conveying direction, passing through a printing area, while its tension is maintained and rewound in a rewinding reel.

A plurality of parallel inkjet printing modules are arranged facing the printing area of the web path for printing thereon.

Each inkjet printing module can print a portion of the width of the web driven through the web path.

The inkjet printing modules are slidably attached to a transverse guide, which is transverse to the printing area of the web path, preferably perpendicular to the conveying direction and parallel to the printing area, allowing for a movement of the inkjet printing modules in said transverse direction, any transverse position of the printing area being reachable by at least one inkjet printing module for printing thereon.

A position device is adapted to drive the inkjet printing modules in the transverse directions along the transverse guide for positioning the inkjet printing modules in the desired transverse positions.

The present invention further comprises the following features, which are not known from the prior art:

- each inkjet printing module includes a first coupling and is independent from other inkjet printing modules allowing an independent movement of each inkjet printing module in a direction transversal to the web path;
- the positioning includes a second coupling complementary to each first coupling, the second coupling being releasably engageable to each first coupling in an automatic manner by an engagement driver, the positioning device being adapted to precisely slide each inkjet printing module engaged thereto, through the engaged first and second couplings, in the direction transversal to the web path.

According to that, each inkjet printing module is independent from the other inkjet printing modules of the inkjet printing station, allowing for an independent movement of each inkjet printing module along the transverse guide. Preferably, all the inkjet printing modules are slidably attached to the same transverse guide.

The positioning device is one positioning device which can sequentially move each independent inkjet printing module to a target position.

Each independent inkjet printing module includes a first coupling releasable engageable in an automatic manner with a second coupling included in the positioning device. Once the first and second couplings are connected, the actuation of the positioning device produces the movement of the engaged inkjet printing module in the transverse direction.

The first and second couplings can be, for example, a hole or a groove and a complementary pin or protrusion. The engagement driver can be an actuator adapted to produce a relative movement between the hole or groove and the pin or protrusion, producing its mutual insertion and extraction.

The engagement driver can be associated to the second coupling, or to each first coupling.

The positioning device can be, for example, a carrier slidably attached to a transverse guide connected to an actuator for driving its movement along said transverse guide. The actuator can be, for example, a motor connected to a pinion engaged to a rack parallel to the transverse guide, or a motor connected to a band forming a closed loop parallel to the transverse guide and connected to one point to the carrier, or a motor connected to a threaded shaft engaged to the carrier to produce its sliding movement in the transverse direction when the threaded shaft rotates.

Alternatively, the positioning device can be a threaded shaft actuated by a motor, the threaded shaft also constituting the second coupling. According to this embodiment, each first coupling will be a threaded configuration releasable engageable at any point along said second coupling shaped as a threaded shaft. The rotation of the threaded shaft will produce the transverse movement of each inkjet printing module engaged thereto in the transverse direction. In this case the engagement driver will be an actuator adapted for moving each first coupling towards, or away from, the threaded shaft.

When each of the digitally modifiable items to be printed can be printed by a single inkjet printing module, for example when that digitally modifiable item is a bar code, a QR code, a batch number, a production date, an expiration date, or similar information, several individual and spaced inkjet printing modules can be arranged to print multiple digitally modifiable items in different transverse positions on a web, for example, when several packages are simultaneously printed in parallel on a single web.

In that case, during the printing operations, the inkjet printing modules shall not be moved, and only between different printing jobs the individual inkjet printing modules have to be moved but the simultaneous movement thereof is not required.

This construction provides a precise, durable and const effective solution for this and other similar applications and allows for a reduction in the number of required inkjet printing modules.

According to an alternative embodiment of the present invention, each inkjet printing module can include a braking device automatically movable between a braked position, where it prevents the sliding movement of the inkjet printing module along the transverse guide, and an unbraked position where allows the sliding movement of the inkjet printing module along the transverse guide, preventing an unintended movement of the inkjet printing modules.

On each inkjet printing module the first coupling and the braking device can be linked to each other, determining an automatic movement of the braking device to the unbraked position when the first coupling is engaged to the second coupling, and determining the return of the braking device to the braked position when the first coupling is disengaged from the second coupling. The linkage between the breaking device and the first coupling can be a mechanical linkage, for example through a cinematic chain, or a linkage by wire, where the breaking device is actuated in response to a signal indicative of the coupling and uncoupling of the first and second couplings. Said signal can be produced by a sensor, by the engagement driver, by the activation signal of the engagement driver or by the control unit controlling the engagement driver.

In an alternative embodiment, each inkjet printing module includes a spacer device configured to move at least the inkjet print heads thereof in a spacing direction perpendicular to the transverse direction, without changing the position of the inkjet printing module in the transverse direction, between a printing position, adjacent to the printing area, and a storage position, spaced apart from the printing area.

An actuator controlled by the control device, such a piston or a motor, will produce the movement of each individual inkjet printing module between the printing position and the storage position, preferably being guided through a guide approximately perpendicular to the web or pivoting around an axis parallel to the transverse direction.

Each inkjet printing module can further include attached thereto a capping system configured to automatically cover the corresponding inkjet printing heads with a cap when in the storage position, to protect the inkjet printing heads from drying and from impacts.

Optionally, the capping system can be activated by the same actuator moving the inkjet printing module between the printing position and the storage position, but an independent activation is also proposed.

Additionally or alternatively, the machine can further include a web thickening awareness signal emitter, for example a thickening detector or a thickening generator, such a splice device or a tag adhesion device. The web thickening awareness signal emitter is located upstream of the inkjet printing station configured to generate a thickening awareness signal in response to the presence of a thickening in the web incoming to the printing area A.

It will be understood that a thickening is an increase in the thickness of the web material affecting only a portion of the longitude of the web material. Said thickening can be produced for example by a splice of the web, by the adhesion of a tag or similar element to the web, an embossing of the web or to a defect in the web material such a wrinkling and/or a breakage of the web.

According to that, the determination of the presence of a thickening on the web can be produced by a thickening sensor, for example an optical sensor facing the web upstream from the printing area, being configured to generate the thickening awareness signal in advance to the detected thickening reaching the printing area.

Alternatively, the determination of the presence of a thickening on the web can be produced by a thickening generator, which will be configured to create a thickening in a position of the web upstream from the printing area, and to generate the thickening awareness signal in advance to the thickening reaching the printing area.

The spacer devices of all the inkjet printing modules will be then configured to move at least the inkjet print heads thereof to the storage position in response to a splice detection obtained from the web thickening awareness signal emitter, increasing the distance between the inkjet print heads and the web to prevent a contact between the slice of the web and the inkjet print heads.

Once the splice has passed through the printing area, the spacer device retorn the inkjet print heads to the printing position.

The printing machine may further include an ink curing/drying station for curing or for drying the ink recently printed on the web. The ink curing/drying station may comprise a plurality of independently movable curer/dryer modules, slidably connected to a curer/dryer transverse guide transverse to the web path.

Each curer/dryer module include at least one curer/dryer emitter facing the web path to emit a curer, such UV light, or a dryer, such hot air, at different regions thereof to cure or dry ink printed on the web by the inkjet printing modules. Each curer/dryer module may include a third coupling.

The positioning device associated with the inkjet printing station, or an additional positioning device when the ink curing/drying station is away from the inkjet printing station, is adapted to precisely slide each of the curer/dryer modules along the curer/dryer transverse guide in the transverse direction. Said positioning device, or said additional positioning device, includes a fourth coupling complementary to the third couplings, the fourth coupling being releasably engageable to each third coupling in an automatic manner by an engagement driver.

In this case, the positioning device, or the additional positioning device, will be adapted to precisely slide each curer/dryer module engaged thereto, through the engaged third and fourth couplings, in the transverse direction.

In will be understood that the additional positioning device is equivalent to the positioning device described above.

Alternatively, each curer/dryer module can be directly linked to one inkjet printing module determining a simultaneous movement in the transverse direction of the curer/dryer module and the inkjet print heat linked together.

The curer/dryer module can be, for example, a UV light emitter, an infrared light emitter, or a hot air blower.

According to an additional embodiment of the present invention, each inkjet printing module carries one decentralized ink storage attached thereto where the ink pressure is precisely regulated to provide ink to the inkjet printing module connected thereto. This simplifies the pipe connections and reduces the amount of ink required to fill pipes.

Alternatively, only some inkjet printing modules carries a decentralized ink storage attached thereto and each of the remaining inkjet printing modules is connected through a pipe to one of those decentralized ink storages. This embodiment creates clusters of inkjet printing modules connected through pipes to a single decentralized ink storage, each cluster being easy to be added, removed, or replaced.

According to a preferred embodiment, each cluster is formed by the inkjet printing module where the decentralized ink storage is attached and by one, or alternatively two, additional inkjet printing module.

In any case, each decentralized ink storage is connected to a centralized ink storage through a pipe and is configured to regulate the ink pressure feed to the inkjet printing modules.

It is also proposed to include, as part of the pulling device, synchronized processing advancing motors connected to the first and second supporting rollers to produce a unison actuation thereof in coordination with the operation of the rest of the pulling unit.

Also, the printing machine can further include a flexographic, offset or rotogravure printing device associated with an additional printing area of the web path to print non digitally modifiable on a web guided through the web path, preferably upstream from the printing unit.

It is also proposed to include, as an option, an optical sensor facing the web path associated with the control unit, which will be adapted to analyze data provided by said optical sensor, to determine the position of non digitally modifiable printed on the web guided through the web path, and to automatically adjust the inkjet printing modules for precisely positioning the digitally modifiable items to be printed in the web in regard to the position of the non digitally modifiable.

The non digitally modifiable item can be printed on the web by the flexographic, offset or rotogravure printing device placed above the printing unit, or can be pre-printed in the web stored in an unwinding reel feeding the web path.

The position of the digitally modifiable items in the transverse direction can be adjusted by moving the inkjet printing modules using the positioning device or by electronically controlling the printing position of the items printed by each inkjet printing module within the printable area facing each inkjet printing module.

The position of the digitally modifiable items in the longitudinal direction, parallel to the conveying direction, is electronically adjusted by precisely controlling the coordination between the inkjet printing modules printing operations and the movement of the web in the conveying direction.

Preferably, the positioning device, and/or each individual inkjet printing module, includes a position detector adapted for determining the real position of each inkjet printing module in the transverse direction. A control device is adapted for controlling the actuation of the positioning device in response to the measurements of said position detector.

This positioning detector can be, for example, integrated in the positioning device and detect a detection target included in each inkjet printing module while the positioning device moves along the transverse direction. Alternatively, each inkjet printing module includes a position detector adapted for determining its position along the transverse guide.

It is also proposed that each independent inkjet printing module is connected to the transverse guide through a connection configuration adapted for manually attaching and releasing the inkjet printing module from the transverse guide in a direction perpendicular to the transverse guide, preferably without requiring tools, for example using a clipping configuration, or a manually operable screws or levers, allowing for an easy and rapid addition or substitution of individual inkjet printing modules.

The proposed printing machine for printing digitally modifiable items can be integrated in a conventional printing machine capable or printing non digitally modifiable items, such a flexographic or offset printing machine, and/or can be integrated in a web treatment machines such a laminating machine, a slitting machine, a laser treatment machine. It will be understood that the conventional printing machine and/or the web treatment machine and the integrated printing machine for printing digitally modifiable items will share the web path so that the same web will pass through the integrated machines for successive treatment thereof.

It will be understood that references to geometric position, such as parallel, perpendicular, tangent, etc. allow deviations up to ±5° from the theoretical position defined by this nomenclature.

Other features of the invention appear from the following detailed description of an embodiment.

BRIEF DESCRIPTION OF THE FIGURES

The foregoing and other advantages and features will be more fully understood from the following detailed description of an embodiment with reference to the accompanying drawings, to be taken in an illustrative and non-limitative manner, in which.

DETAILED DESCRIPTION OF AN EMBODIMENT

Figure 1:
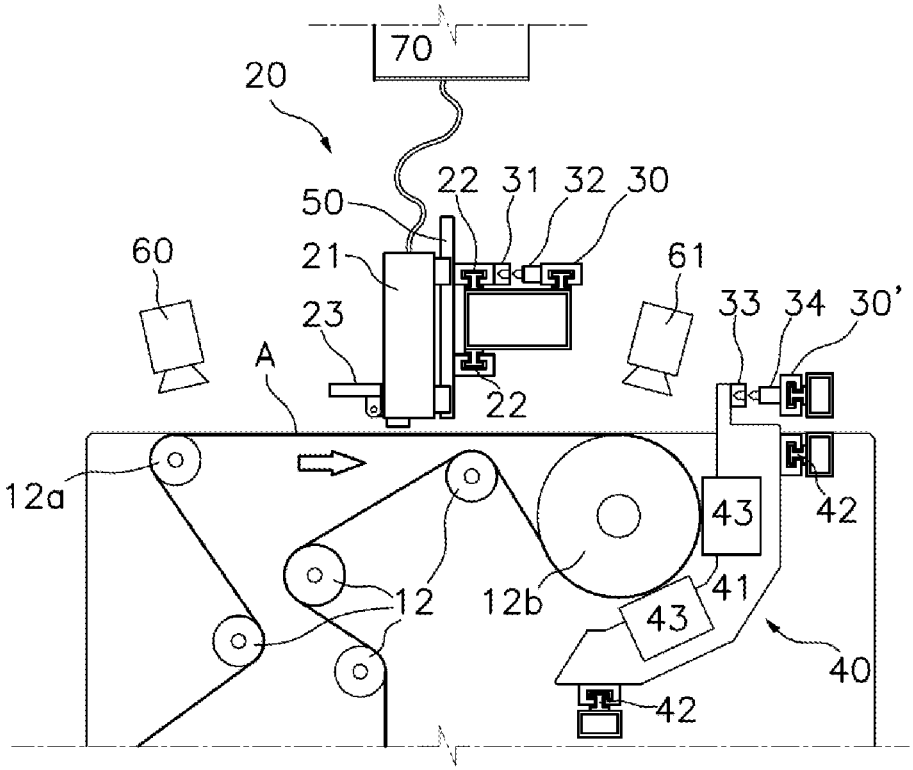
FIG. 1 shows a transverse section of the printing machine according to one embodiment, with one inkjet printing module in the printing position.

The foregoing and other advantages and features will be more fully understood from the following detailed description of an embodiment with reference to the accompanying drawings, to be taken in an illustrative and not limitative.

According to a preferred embodiment of the present invention, the printing machine includes a feeding unit 10 with multiple rollers 12 for guiding a flexible web through a web path between an unwinding reel and a rewinding reel.

Two of said rollers 12 are a first supporting roller 12*a* and a second supporting roller 12*b* which define, in between, a flat printing area A of the web tensioned between the first and second supporting rollers 12*a*, 12*b*.

According to the present embodiment, each of the first and second supporting rollers 12*a*, 12*b*, is actuated by one processing advancing motors, being both synchronized to precise control the tension of the flexible web between said first and second supporting rollers 12*a* and 12*b*, said actuation being in coordination with the rest of the pulling unit which moves the flexible web in the conveying direction along the web path.

The printing machine further comprises a transverse bridge or beam, perpendicular to the conveying direction, supporting an inkjet printing station 20 above the printing area A.

The inkjet printing station includes, for example, two parallel horizontal transverse guides 22 transverse to the web path attached to said transverse bridge or beam.

The inkjet printing station 20 further comprises multiple inkjet printing modules 21, each inkjet printing module 21 including, in a removable and disposable unit, inkjet print heads configured to eject ink droplets against a portion of the width of the printing area A in precise positions, each inkjet printing module 21 being able to print a fringe on the flexible web.

Each inkjet printing module 21 is slidably attached to said two parallel transverse guides 22 through carriages, allowing for a movement thereof in the transverse direction, parallel to the web of the printing area A, each inkjet printing module 21 being positionable in any transverse position above the printing area A for printing a fringe thereon.

Figure 2:
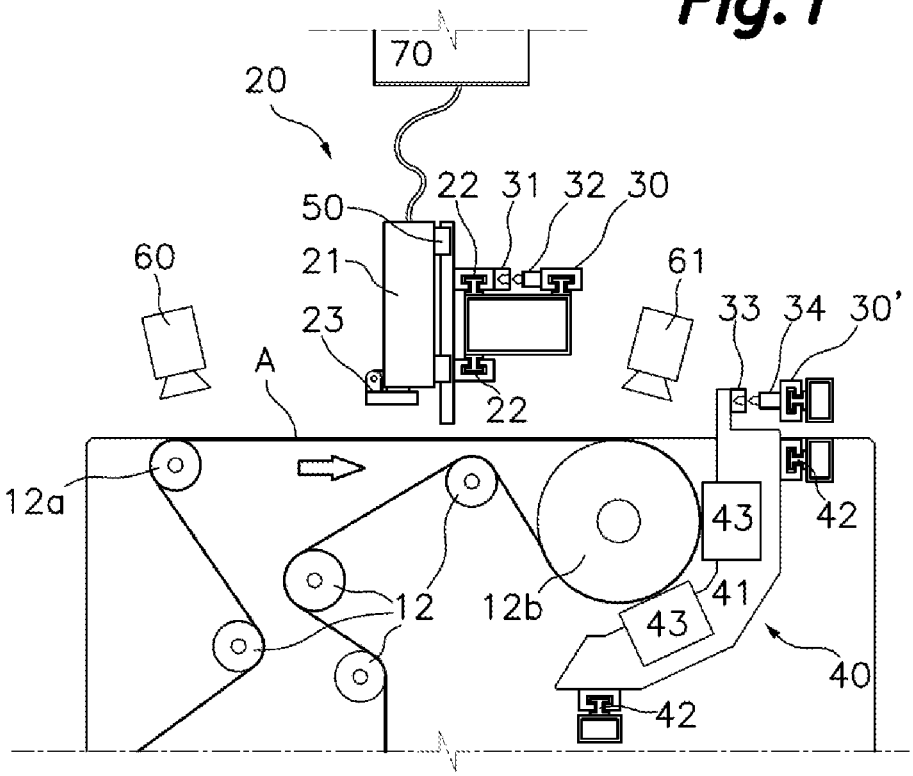
FIG. 2 shows the same zoom view as FIG. 1, but with the inkjet printing module in the storage position.
Figure 3:
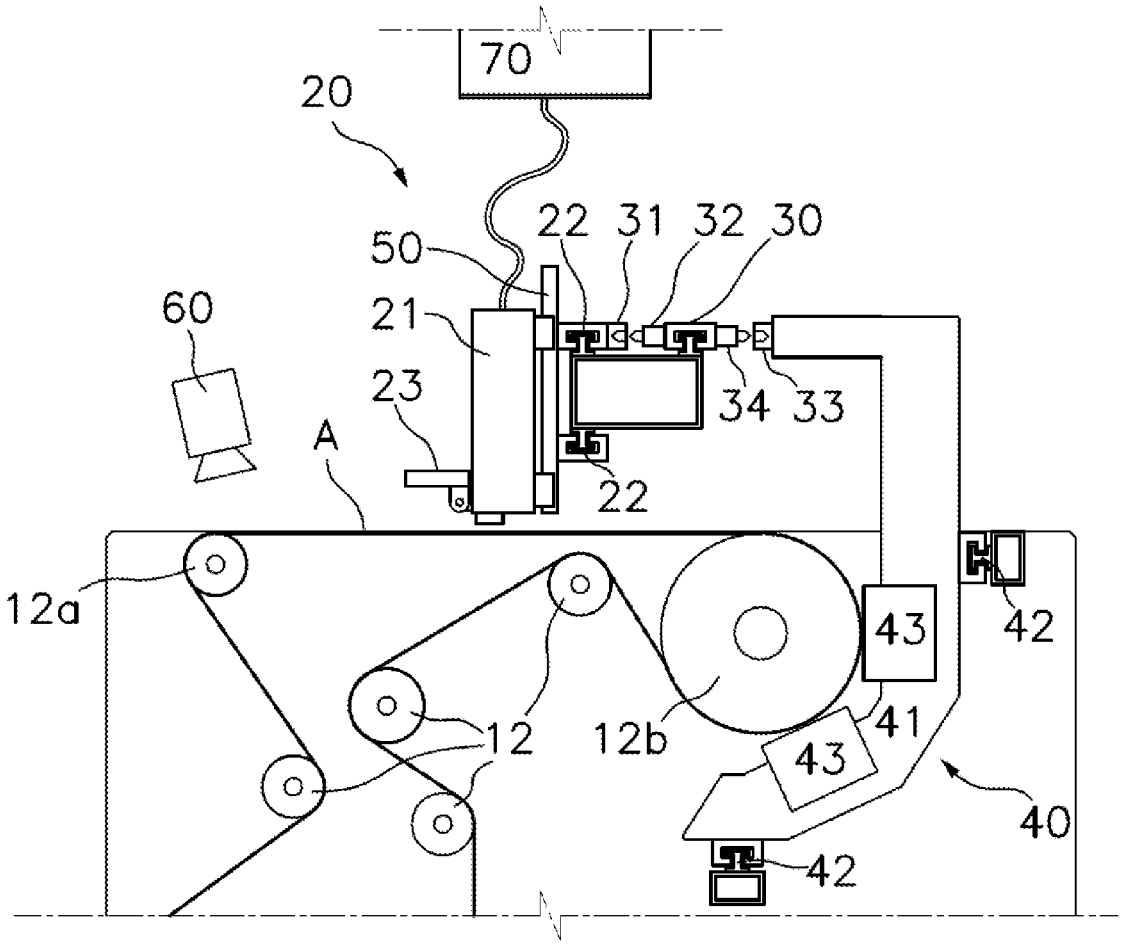
FIG. 3 shows the same view as FIG. 1 but according to an alternative embodiment wherein the positioning device can engage with both the inkjet printing modules and the curing/drying modules.
Figure 4:
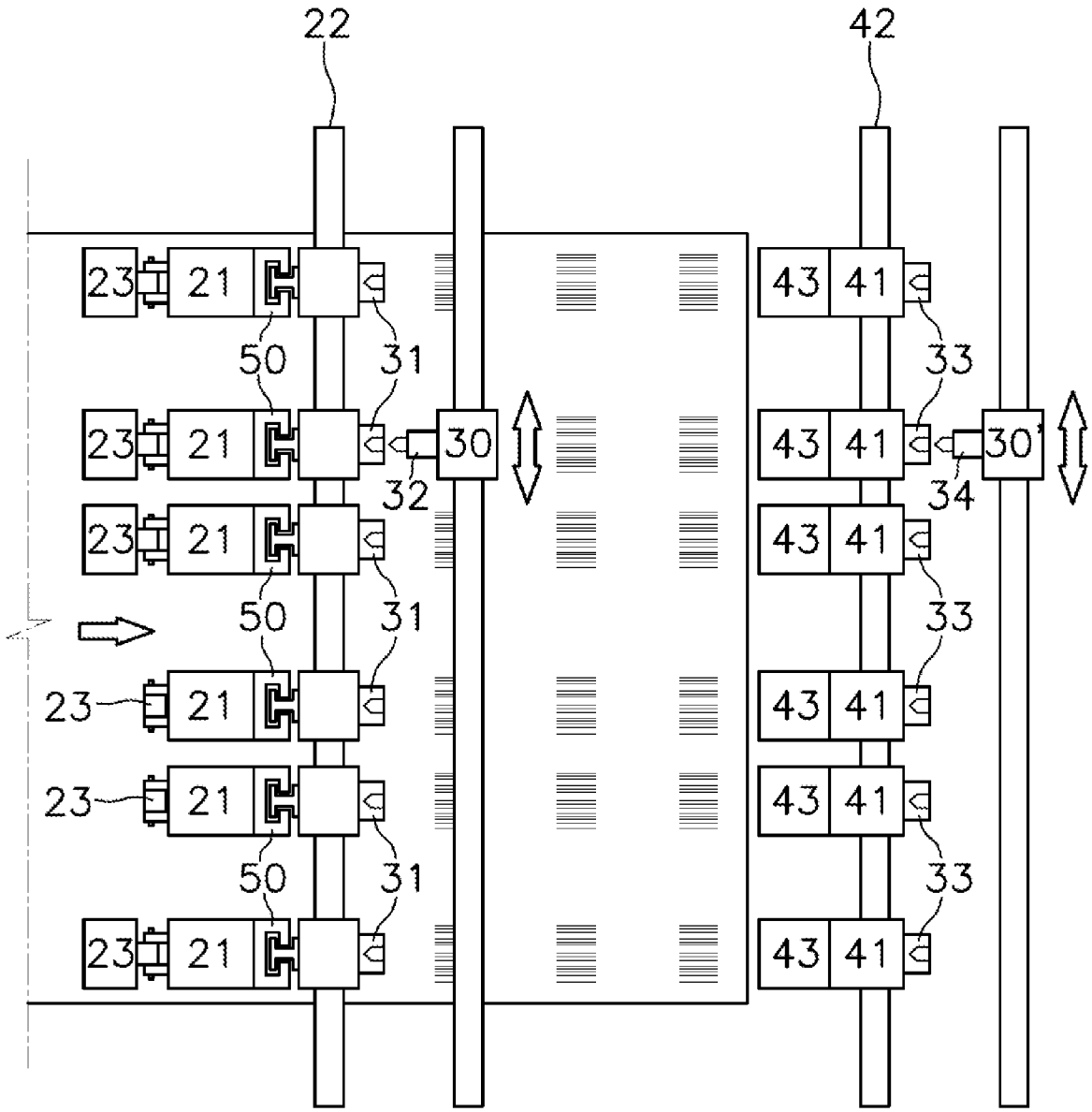
FIG. 4 shows a plan view of the printing area of the printing machine shown in FIGS. 1, 2 and 3, with the inkjet printing station including six inkjet printing modules in different transverse positions, the printing area including several digitally modifiable items, shown as bar codes, printed therein.

Each inkjet printing module 21 also includes spacer device 50 comprising a vertical track placed between the inkjet print heads and the corresponding carriages, permitting the vertical movement of the inkjet print heads between a printing position, where the inkjet print heads are close to the printing area A and can print thereon, as shown in FIG. 1, and a storage position where the inkjet print heads are spaced apart from the printing area A, as shown in FIG. 2, said distance being too wide for allowing a precise printing.

Each spacer device 50 further includes an actuator integrated in the inkjet printing module 21 adapted for moving the inkjet print heads of one inkjet printing module 21 between the printing position and the storage position along the vertical track, said movement being independent from the movement of the inkjet print heads from other inkjet printing modules 21.

Each inkjet printing module 21 also includes a capping system 23 comprising a cap intended for covering the printing inkjet print heads of the inkjet printing module 21 preventing its drying, and an actuator device intended for moving said cap between a capping position, where the cap covers the inkjet print heads, and a printing position where the cap is away from the inkjet print heads and not interferes with the web path when the inkjet printing module 21 is in the printing position.

In this embodiment, the cap is pivotally attached to the inkjet printing module 21, but an alternative embodiment in which the cap is slidably attached thereto is also possible.

When an inkjet printing module 21 is in the printing position the cap shall be in the printing position, as seen in FIG. 1. But when an inkjet printing module 21 is in the storage position, the capping device 23 can be actuated to place the cap in the capping position, as shown in FIG. 2.

According to one embodiment of the present invention, each inkjet printing module 21 includes a decentralized ink storage adapted to regulate the pressure of the ink to be provided to the inkjet print heads of said inkjet printing module 21.

Alternatively, only some of the inkjet printing modules 21 include a decentralized ink storage, for example only alterne inkjet printing modules 21, or one of every three inkjet printing modules 21, and each of the remaining inkjet printing modules 21 are connected to a decentralized ink storage of an adjacent inkjet printing module 21 through a flexible pipe allowing for an independent movement between the connected inkjet printing modules 21.

Each decentralized ink storage is connected through flexible pipes to a centralized ink storage 70, where the ink is stored and from where the ink is distributed to the decentralized ink storages.

The printing machine further comprises a positioning device 30 intended for its coupling to each single inkjet printing module 21 and for dragging said inkjet printing module 21 along the transverse guide 22.

Each inkjet printing module 21 includes a first coupling 31, and the positioning device 30 includes a second coupling 32 complementary to the first coupling 31.

The second coupling 32, or each of the first couplings 31, is actuated by an engagement driver which produces the automatic coupling and uncoupling between the first and second couplings 31, 32, when in a suitable position.

In the example shown in FIGS. 1, 2, 3 and 4 the first coupling 31 is defined by a hole perpendicular to the transverse direction, and the second coupling 32 is defined by an actuated plunger which, when extended, can be inserted in one of said holes and when retracted does not interfere with none of said holes, being said actuated plunger connected to a carriage movable in the transverse direction to align the actuated plunger with different of said holes.

Figure 5:
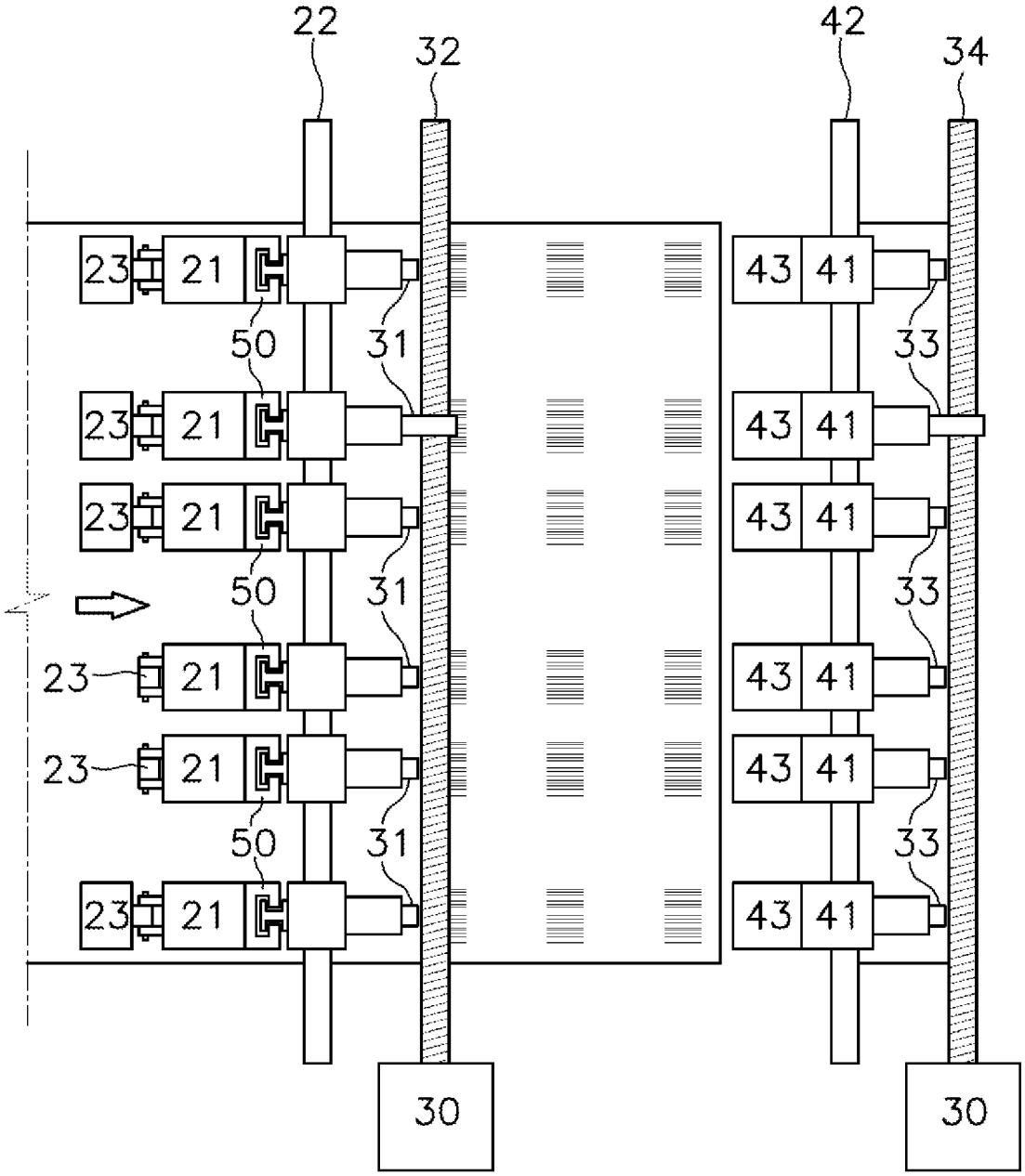
FIG. 5 shows the same view as FIG. 4 but according to an alternative embodiment of the positioning device.

In the example shown in FIG. 5, the second coupling configuration 32 is a threaded shaft parallel to the transverse guides 22, and each inkjet print module 21 include one first coupling configuration 31 comprising one According to a first embodiment, the positioning device 30 is a carriage slidably attached to a positioning transverse guide parallel to the transverse guides 22 of the inkjet printing station 20 and actuated by a driving unit which produces the movement of the carriage in the transverse direction, positioning the second coupling 32 adjacent to one first coupling 31 of one inkjet printing module 21, enabling the coupling thereof and the drag of the inkjet printing module 21 coupled to the positioning device 30.

According to an alternative embodiment, the positioning device is a threaded shaft parallel to the transverse guides 22 which rotates along its axis by an actuator. Said threaded shaft constitutes the second coupling 32, where each of the first coupling 31 can be engaged independently by a corresponding engaging drive. When a first coupling 31 is engaged with the threaded shaft, the rotation of the threaded shaft produces the movement of the engaged inkjet printing module 21 in the transverse direction.

According to an alternative embodiment, the printing machine further comprises an ink curing/drying station 40 which comprises a plurality of curer/dryer modules 41, such UV emitters, infrared emitters, or air blowers.

Each curer/dryer module 41 will affect a portion of the width of the web path equivalent to the width of one fringe printable by one inkjet printing module 21.

Each curer/dryer module 41 is slidably attached to a curer/dryer transverse guide 42 allowing its individual movement in the transverse direction.

According to one embodiment, each curer/dryer module 41 includes a third coupling 33 complementary to a fourth coupling 34 included in the positioning device 30 or included in an additional positioning device 30' equivalent to the positioning device 30 described above.

The coupling and uncoupling between the third and fourth couplings 33, 34 is produced by an engagement driver when in a suitable position.

Alternatively, each curer/dryer module 41 is directly connected to one inkjet printing module 21 for its simultaneously movement.

It will be understood that various parts of one embodiment of the invention can be freely combined with parts described in other embodiments, even being said combination not explicitly described, provided that such combination is within the scope of the claims and that there is no harm in such combination.

The invention claimed is:

1. Printing machine for printing a laminar web, the printing machine comprising:

rollers defining a web path for guiding a web, the rollers comprising first and second supporting rollers defining therebetween a printing area of the web path, a pulling device being adapted to maintain a constant tension in the web guided through the printing area;

an inkjet printing station comprising a plurality of inkjet printing modules with inkjet print heads facing the printing area of the web path for printing thereon, the inkjet printing modules being slidably arranged along a transverse guide transverse to the web path, each inkjet printing module being adapted for printing a fraction of the width of the printing area with digitally modifiable items;

a positioning device adapted to precisely slide the inkjet printing modules along the transverse guide in the direction transversal to the web path; and each inkjet printing module includes a first coupling and is independent from other inkjet printing modules allowing an independent movement of each inkjet printing module along the transverse guide, the positioning device including a second coupling complementary to each first coupling, the second coupling being releasably engageable to each first coupling in an automatic manner by an engagement driver, the positioning device being configured to precisely slide each inkjet printing module engaged thereto, through the engaged first and second couplings, along the transverse guide.

2. The printing machine according to claim 1, wherein each inkjet printing module includes a braking device automatically movable between a braked position, where the braking device prevents the sliding movement of the inkjet printing module along the transverse guide, and an unbraked position where allows the sliding movement of the inkjet printing module along the transverse guide.

3. The printing machine according to claim 2, wherein on each inkjet printing module the first coupling and the braking device are linked to each other, determining an automatic movement of the braking device to the unbraked position when the first coupling is engaged to the second coupling and determining the return of the braking device to the braked position when the first coupling is disengaged from the second coupling.

4. The printing machine according to claim 1, wherein each inkjet printing module includes a spacer device configured to move at least the inkjet print heads thereof in a spacing direction perpendicular to the transverse direction, without changing the position of the inkjet printing module in the transverse direction, between a printing position adjacent to the printing area and a storage position spaced apart from the printing area.

5. The printing machine according to claim 4, wherein each inkjet printing module includes attached thereto a capping system configured to automatically cover the corresponding inkjet printing heads with a cap when in the storage position; and/or the machine includes a web thickening awareness signal emitter upstream of the inkjet printing station configured to detect a splice in the web, the spacer devices of all the inkjet printing modules being configured to move at least the inkjet print heads thereof to the storage position in response to a splice detection obtained from the web thickening awareness signal emitter.

6. The printing machine according to claim 1, wherein the printing machine further includes an ink curing/drying station comprising a plurality of independently movable curer/dryer modules slidably connected to a curer/dryer transverse guide, transverse to the web path, to emit a curer/dryer at different regions of the web, by at least one curer/dryer emitter included in each curer/dryer module facing the web path, to cure/dry ink printed on the web by the inkjet printing modules, each curer/dryer module includes a third coupling, and the positioning device, or an additional positioning device adapted to precisely slide the curer/dryer modules along the curer/dryer transverse guide in the transverse direction, includes a fourth coupling complementary to the third couplings, the fourth coupling being releasably engageable to each third coupling in an automatic manner by an engagement driver, the positioning device, or the additional positioning device, being adapted to precisely slide each curer/dryer module engaged thereto, through the engaged third and fourth couplings, in the transverse direction.

7. The printing machine according to claim 1, wherein the printing machine further includes an ink curing/drying station comprising a plurality of independently movable curer/dryer modules, facing the web path and slidably connected to a curer/dryer transverse guide transverse to the web path, to emit a dryer at different regions thereof to dry ink printed on the web by the inkjet printing modules, each curer/dryer module is linked to one inkjet printing module determining a simultaneous movement in the transverse direction of the curer/dryer module and the inkjet print heat linked together.

8. The printing machine according to claim 6, wherein the curer/dryer module is a UV light emitter, an infrared light emitter, or a hot air blower.

9. The printing machine according to claim 7, wherein the curer/dryer module is a UV light emitter, an infrared light emitter, or a hot air blower.

10. The printing machine according to claim 1, wherein each inkjet printing module carries a decentralized ink storage attached thereto, or some inkjet printing modules carries a decentralized ink storage attached thereto and each of the remaining inkjet printing modules is connected through a pipe to one of those ink storages, and each decentralized ink storage is connected to a centralized ink storage through a pipe and is configured to regulate the ink pressure feed to the inkjet printing modules.

11. The printing machine according claim 1, wherein the pulling device includes synchronized processing advancing motors connected to the first and second supporting rollers to produce a unison actuation thereof in coordination with the operation of the rest of the pulling unit.

12. The printing machine according to claim 11, wherein a first tension sensor is arranged for measuring the tension of the film web upstream of the main pulling unit and downstream of the inkjet printing modules, and an electronic control device controls the operation of the processing advancing motor based on a control signal received from the first tension sensor.

13. The printing machine according to claim 1, wherein the printing machine further includes a flexographic, offset or rotogravure printing device associated with an additional printing area of the web path to print non digitally modifiable on a web guided through the web path.

14. The printing machine according to claim 1, wherein an optical sensor faces the web path and is associated with a control unit adapted to analyze data provided by the optical sensor, determine the position of the non-digitally modifiable items printed on the web guided through the web path, and automatically adjust the inkjet printing modules for precisely positioning the digitally modifiable items to be printed in the web in regard to the position of the non-digitally modifiable items.

15. The printing machine according to claim 1, wherein the positioning device and/or each individual inkjet printing module includes a position detector adapted for determining the real position of each inkjet printing module in the transverse direction, and a control device is adapted for controlling the actuation of the positioning device in response to the measurements of the position detector.

* * * * *